United States Patent [19]

Burchart

[11] 4,429,639

[45] Feb. 7, 1984

[54] MONEY-DISPENSING DEVICE FROM A SAFE'S SPACE

[75] Inventor: Joachim Burchart, Schlangen, Fed. Rep. of Germany

[73] Assignee: Nixdorf Computer AG, Paderborn, Fed. Rep. of Germany

[21] Appl. No.: 308,230

[22] Filed: Oct. 5, 1981

[30] Foreign Application Priority Data

Oct. 7, 1980 [DE] Fed. Rep. of Germany ..... 3037839

[51] Int. Cl.[3] ..... E06B 7/32

[52] U.S. Cl. ..... 109/19; 109/23; 221/12

[58] Field of Search ..... 109/73, 19, 10, 23 R, 109/11, 22, 41–43, 4; 221/12, 9, 2, 4, 6, 227–232; 194/DIG. 9, DIG. 8, DIG. 12, DIG. 26; 49/362

[56] References Cited

U.S. PATENT DOCUMENTS

| | | | |
|---|---|---|---|
| 451,317 | 4/1891 | Carman | 109/19 |
| 640,998 | 1/1900 | Dodge | 268/73 |
| 3,357,133 | 12/1967 | Helsing | 221/12 |
| 3,880,320 | 4/1975 | Morello et al. | 221/9 |
| 3,918,201 | 11/1975 | Graziano | 49/28 |
| 4,190,004 | 2/1980 | Richardson | 109/19 |
| 4,251,009 | 2/1981 | McLaughlin et al. | 221/12 |
| 4,320,854 | 3/1982 | Hirose | 221/12 |

FOREIGN PATENT DOCUMENTS

| | | | |
|---|---|---|---|
| 695122 | 9/1964 | Canada | 109/4 |
| 2428727 | 11/1980 | France | 109/10 |
| 102735 | 2/1916 | United Kingdom | 109/19 |
| 1549860 | 8/1979 | United Kingdom | 109/19 |
| 1587410 | 4/1981 | United Kingdom | 109/19 |

*Primary Examiner*—Gene Mancene
*Assistant Examiner*—James Hakomaki
*Attorney, Agent, or Firm*—Krass, Young & Schivley

[57] ABSTRACT

A money dispensing device for use in safes or the like which transfers money from a security area to a dispensing point. A powered drawer transfers money from the security area to the dispensing point. The dispensing point is provided with a door, which is automatically controlled, such that the door opens only when sensors indicate that the drawer has reached the end of the dispensing point, and after opening, the door closes only when sensors indicate that the drawer is empty.

13 Claims, 6 Drawing Figures

FIG. 3
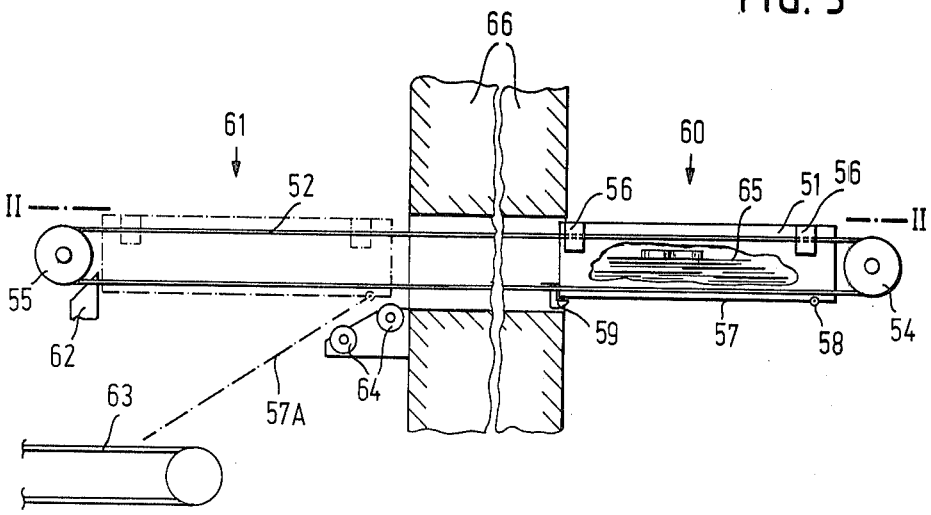
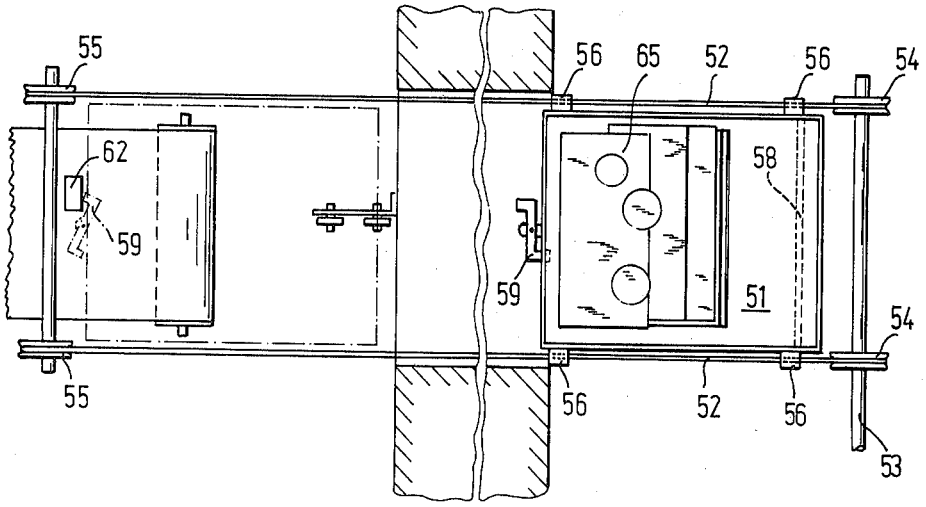
FIG. 4

MONEY-DISPENSING DEVICE FROM A SAFE'S SPACE

DESCRIPTION

1. Technical Field

The invention relates to a device for dispensing flat objects from a closed receptacle, in particular for dispensing certificates and coins through the wall of a safe by means of a conveying arrangement which conveys the objects from a receiving place inside the receptacle out through a wall opening to a removal place outside the receptacle.

2. Background Art

Devices for dispensing flat objects, such as sheet material for example, are widely used in machines which handle sheet material, for example in copying and sorting machines. Devices of this kind are also used in automatic money-dispensing apparatus in which certificates are collected in a certain sequence and amount and are then dispensed through a receptacle wall. This usually involves thick-walled safes in which a dispensing opening relatively large in size is made.

Devices for dispensing flat objects, such as coins for example, are used frequently in coin changers, change dispensers of automatic goods and game machines and in token dispensers for deposit and telephone coins.

With money dispensing units it is generally customary to issue only bank notes, not coins. It must be expected of a universally applicable money dispensing apparatus, however, that paper money and coins will be dispensed in any combination whatever. This is especially required in automatic money changing machines with which the desired amount is to be paid in a foreign currency, which leads to sums which cannot entirely be made up of bank notes.

Another requirement generally imposed in connection with these uses is that the conveying process must not be able to be interfered with by outside manipulations, especially with certificate receptacles. Moreover, in the case of closed receptacles, large receptacle openings should be avoided insofar as possible in order not to impair the security acheived by a closed receptacle.

The previous devices for dispensing sheet material operate with conveying arrangements which take up the sheet material between driving rollers and back pressure rollers and transfer it to other pairs of rollers until it has been passed through the wall opening of the receptacle. As a result of the use of roller mechanisms a large receptacle opening is necessarily required for this, which in the case of a certificate receptacle increases the risk of an influence being exerted from the outside.

For the conveying of coins, inclined conveying channels are generally used in the known devices, through which channels the coins slide of their own weight. Another opening in the wall of the safe is required for the sliding path in addition to that required for the certificates.

DISCLOSURE OF THE INVENTION

It is the problem of the invention to supply a capability of dispensing flat objects, particularly certificates and coins, from a closed receptacle for which only one receptacle opening is required, which opening moreover can be constructed as small as possible, and in which the whole of the conveying elements are conveniently accessible from the outside, so that a simple construction as well as a problem-free maintenance results. Moreover any influence or manipulation in the receptacle's internal space through the wall opening should be practically impossible.

This problem is solved according to the invention, for a device of the type mentioned at the outset, by having a narrow channel provided from the receiving place to the removal place in which a conveying drawer runs, by having the front and rear wall of this drawer constructed as armor plates and by having at least one of these armor plates inside the channel in the extreme positions of the drawer in its conveying route and having it close off the channel.

Through the principle provided by the invention of conveying flat objects in a conveying drawer, it is possible to convey any number of objects with very different surface configurations and thicknesses in one single conveying operation through the wall opening of the receptacle. Any limitation to the amount and size of the material conveyed is set only by the dimensions of the drawer.

With the use of the principle of the invention for automatic money-dispensing machines, a slot-shaped channel only a few centimeters wide and a few millimeters high in the receptacle wall is all that is required.

Notwithstanding this, the conveying principle is very reliable; even bent sheet material is securely conveyed.

Since the material delivered is conveyed in a drawer, except for the guide for the drawer no conveying elements such as guide rollers or deflector rollers or conveyer belts need be provided inside the receptacle wall or wall opening. Due to this the most important parts of the device are easily accessible and can be replaced or serviced in a simple way.

Of special significance is the design of the front and rear wall of the drawer as armor plates and the limitation of the free conveying path of the drawer in such a way that at least one of the armor plates is inside the wall opening in the extreme positions of the conveying route. For this the armor plates must be only insignificantly smaller than the inside width of the opening. This is particularly significant in regard to the use of the device in safety receptacles, since it makes any action on the receptacle's internal space practically impossible.

A further advantage of the design of the conveying device as a conveying drawer is that the latter on the removal side represents the removal pan for the material delivered at the same time. Any transfer of the material delivered to auxiliary conveying means such as conveyer belts or driving rollers is eliminated here.

In a further development of this inventive concept, the conveying drawer forms the bottom of the money-dispensing compartment on the front side of a money-dispensing device. As soon as the drawer has reached the extreme position of its conveying route on the dispensing side, a lid in front of the money-dispensing compartment is opened by means of suitable circuit components and driving means, and the user can reach in and take out the money deliverd. At the same time as the opening of the lid, locking mechanisms are actuated which fix the drawer in its position.

The problem of the invention, that of complying with strict security requirements, is satisfied to a high degree in this way: during the drawer's time of movement the lid is closed and the conveying cannot be prevented. The drawer in its extreme position completely fills out the lower surface of the money-dispensing compartment and the armored rear side of the drawer closes off the wall opening. No point of attack for tools is presented.

In a further development of the concept of the invention, the bottom of the drawer is provided with small openings. In the extreme position of the drawer on the dispensing side these openings clear the light path of photoelectric cells which signal the full state of the drawer to the drawer and lid motion control. Only when the drawer is fully emptied does the lid of the money-dispensing compartment close and the drawer travel back to the receiving place in the interior of the safe. In this way it is ensured in an advantageous manner that on the one hand the user can take out the whole of the delivered material before the lid closes, and on the other hand that the drawer will not travel into the safe when explosives or incendiary agents are placed in it in order to destroy the contents of the safe.

A further protection against manipulation is offered by circuit elements signaling the extreme position of the conveying drawer on the dispensing side: if the drawer is moved away from its extreme position by force, then the two operating state messages "drawer not in its extreme position" and "driving means not in operation" will cause an alarm signal.

To prevent the conveying mechanism complete with the drawer from being ripped out by force from its mounting support and driven into the interior of the safe, massive stops are provided on the inside of the safe's wall against which supports the armored front wall is supported in the interior of the safe.

The drawer cannot be taken out of its extreme position outside the safe, since its front wall fits into a recess in the front wall of the money-dispensing device and the rear wall is in the opening in the wall of the safe.

The drive mechanism for the conveying motion of the drawer is advantageously formed by worm-gear spindles on both sides of the drawer. Bores in the armor plates of the drawer are then provided with the conveying worm gear. It is advantageous for a self-locking worm gear to be provided for the spindles so that the drawer cannot be moved by hand.

In another embodiment the drawer is moved by endless cables on both sides of the drawer. Deflecting rollers are located on both sides of the safe's wall and the drawer is also suspended on the cables.

This embodiment has the advantage of an especially low expense. Moreover the wall opening may have a particularly small width, since the cables require very little room. Here too, multiple loopings around the driving rollers will prevent the drawer from being pushed by force against the drive mechanism at rest.

In a third embodiment the drawer is moved by a crank drive. The crank drive is built into the interior of the safe and acts on the rear wall of the drawer. The especial advantage of this embodiment is the complete inaccessibility of the drive to the manipulation attempts. The stopping points of the drawer at the receiving and removal places coincide with the rear and the front dead center positions of the crank drive, so that any forcible pushing of the drawer against the stationary drive is impossible. A further advantage of this arrangement is that the driving motor always rotates in only one direction, thereby rendering any additional reversing means superfluous.

In a further development of the conveying drawer according to the invention, the bottom of the drawer is constructed as a movable lid. A release mechanism, which is actuated either by an electromagnet or by the encounter with a stop in the extreme position of the drawer at its removal position, releases the bottom lid, this drops down and the conveyed material slides into the space below the drawer.

The advantage of this further development is that delivered material which has been assembled imperfectly, for example, can still be brought to the receiving place in a collecting receptacle in the interior of the safe and does not become accessible to the user.

If a number of money removal places are to be loaded by one currency dispensing mechanism, then conveying means must be arranged under the drawer outside the safe which will handle the distribution of the delivered material.

The essential features of the invention as well as possible further developments are described in the following on the basis of an embodiment example represented in the figures.

BRIEF DESCRIPTION OF THE DRAWINGS

FIG. 3 shows a side view of a conveying device with a conveying drawer driven by a cable drive, the bottom of which drawer is constructed as a lid;

FIG. 4 shows a top plan view of the device shown in FIG. 3;

BEST MODE FOR CARRYING OUT THE INVENTION

Figure 1:
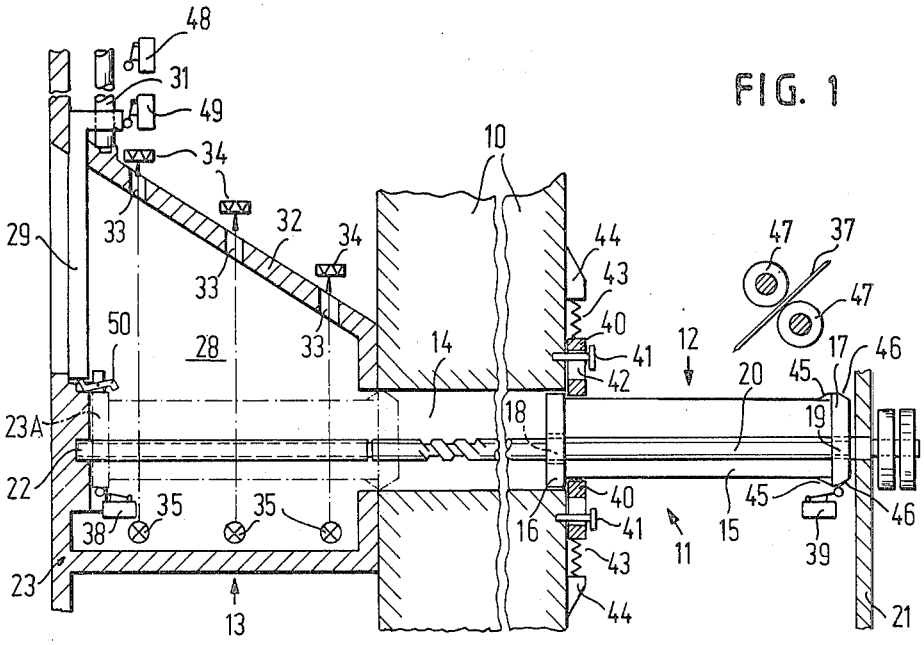
FIG. 1 shows a side view of a conveying device with a conveying drawer driven by spindles.
Figure 2:
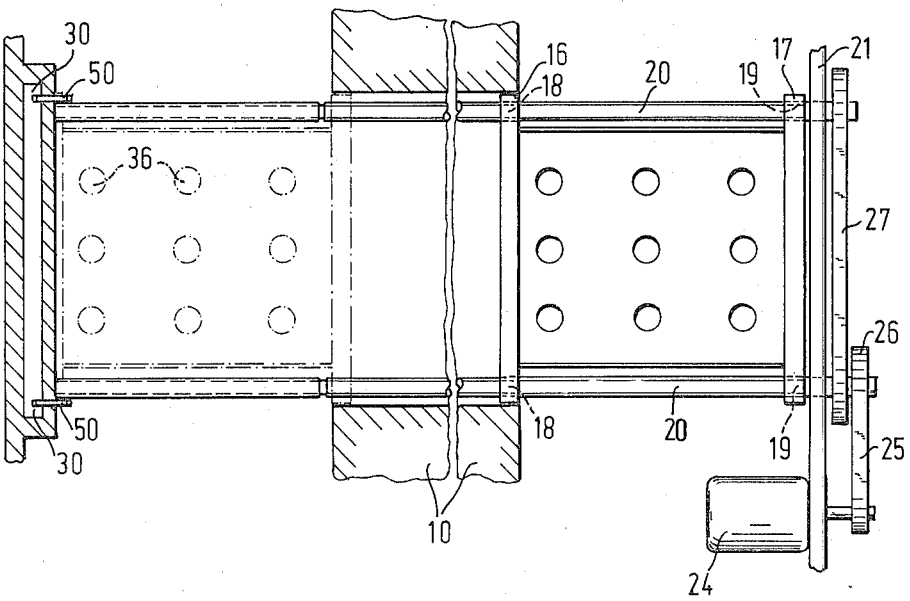
FIG. 2 shows a top plan view of the device shown in FIG. 1.

FIGS. 1 and 2 represent a device for dispensing certificates and coins through the wall 10 of a safe. This uses a conveying arrangement 11 which conveys the material delivered from a receiving place 12 through the opening 14 in the safe's wall 10 to a removal place 13.

The conveying arrangement 11 consists of a drawer 15 open at the top, the front wall 16 and rear wall 17 of which are constructed as armor plates. These armor plates project far enough beyond the lateral limits of the drawer 15 so that there is room for bores 18, 19 in the projections. The bores 19 in the rear wall 17 are provided with conveying worm gears in which spindles 20 provided with worm gears run in such a way that the drawer is moved forward or backwards by the rotation of the spindles 20 to the right or the left, respectively. The bores 18 in the front wall 16 have a diameter insignificantly larger than the gear diameter of the spindles 20, so that the front wall 16 easily slides on the spindles 20.

The spindles 20 are supported in the interior of the safe in a mounting wall 21 and on the outside are supported by bearings 22 on the front wall 23 of the money-dispensing apparatus.

The bearings 22 are constructed substantially in tubular form, the outer diameter of the tubular parts of the bearing being the same as that of the spindles 20 and their length being the same as the inside distance from the front wall 23 to the wall 10 of the safe.

The worm gear of the spindles 20 extends from the mounting wall 21 up to the bearings 22. There the spindles taper off in such a way that they can easily rotate in the tubular parts of the bearings 22. In this way the spindles 20 are withdrawn from any access from outside the safe and cannot be rotated by hand in order to move the drawer 15 manually.

If the drawer 15 is conveyed to the removal place 13, then the front wall 16 of the spindles 20 easily slides on the tubular parts of the bearing 22, but the conveying worm gears in the bores 19 in the rear wall 17 remain engaged with the worm gear of the spindles 20 in each position of the drawer.

The spindles 20 are rotated by a motor 24 (FIG. 2) which with a cogged belt 25 drives a belt pulley 26 which is rigidly joined to one of the spindles 20. A second cogged belt 27 transmits the driving force from one spindle to the other.

The front wall 23 is spaced apart from the safe's wall 10 by a distance about the same as the length of the drawer 15. The resulting intermediate space is delimited above and to the side by having the front wall 23 drawn inward in the shape of a funnel. The removal compartment 28 thus formed is delimited below by the drawer 15 as soon as the latter is at the removal place 13. This removal compartment 28 is closed by a lid 29. The lid 29 is laterally guided in guide grooves 30 (FIG. 2) and can be moved upward behind the front wall 23 by a conveying spindle 31, in which way the removal compartment 28 is freed for access. The "open" and "closed" positions of the lid 29 are signaled by limit switches 48 and 49.

Hook-shaped drawer locking mechanisms 50 located outside the region of accessibility of the removal compartment 28 are actuated by the lid 29. As soon as the lid 29 moves out of its closed position, the drawer locking mechanisms 50 hook on behind the front wall 16 of the drawer 15 which is at the removal place 13 and hold this drawer firmly so that it cannot be shifted, until the lid 29 is closed and thereby the drawer locking mechanisms 50 are released again.

The upper bounding wall 32 of the removal compartment 28 is provided with bores 33 above which there are photoelectric sensors 34 outside the removal compartment 28. Below the space taken up by the drawer 15 at the removal place 13 there are light-emitting structural elements 35 the light rays of which strike through openings 36 (FIG. 2) in the bottom of the drawer 15 and through the bores 33 to the photosensors 34.

Massive stops 40 are placed above and below the opening 14 on the inside of the wall 10 of the safe. These stops 40 are fastened onto the wall 10 of the safe with bolts 41 which run in slotted holes 42 in the stops 40. The stops 40 rest against supports 44 by means of pressure spring 43 in such a way that they project into the opening 14.

If the drawer 15 is in its extreme position is at the receiving place 12, the front wall 16 rests against the stops 40 in such a way that pushing it further beyond this extreme position is practically impossible.

If the drawer 15 is conveyed to the removal place 13, the rear wall 17 of the drawer strikes against the stops 40. Front guide bevels 45 on the rear wall 17 now force the stops 40 out upward or downward against the pressure springs 43, so that the drawer 15 can be conveyed further without further hindrance. Behind the drawer 15 the stops 40 return to the locking position with the slotted holes 42 sliding on the bolts 41 and driven by the pressure springs 43.

During the reverse conveying of the drawer 15 from the removal place 13 to the receiving place 12, rear guide bevels 46 open the conveying route to the rear walls 17 in the same way.

In another conceivable embodiment the stops 40 are rigidly placed on the wall 10 of the safe or are parts of the latter. The rear wall of the drawer 15 must then be smaller than the front wall in order to slide through the opening without hindrance. For this embodiment it must be borne in mind that at the removal place 13 the rear wall 17 does not completely close the opening 14.

In its extreme position at the removal place 13 the front wall 16 of the drawer 15 fits into a recess 23A in the front wall 23 in such a way that the boundary edges of the recess 23A prevent the drawer 15 from being taken out on all sides.

The material delivered is essentially assembled from certificates and coins of whatever kind. The certificates 37 are conveyed by suitable conveying means, represented symbolically as conveying rollers 47, to the receiving place 12 in the drawer 15. The same is done with coins—not represented. After the filling operation is finished, the motor 24 is switched on, whereby the drawer 15 is conveyed to the removal place 13. Here it actuates a limit switch 38 which switches off the motor 24.

The limit switch 38 also causes the opening of the lid 29. This is done by having the conveying spindle 31 start being driven either by a motor, which is not represented, or by the driving force of the motor 24 by way of at least one of the spindles 20—after the drive of the drawer 15 has been disengaged and the conveying spindle 31 has been engaged by a reversing gear, not represented.

In its extreme position in its opened state the lid 29 actuates the limit switch 48, whereby the lid drive running in the direction of opening is switched off.

The material delivered can now be removed from the drawer 15. After the drawer 15 is completely emptied, all the openings 36 in the bottom of the drawer are cleared; the empty state of the drawer 15 is signaled by the photosensors 34. This signal sets off the closing of the lid 29. As soon as this is completely closed, the limit switch 49 is actuated. This sets off the return of the drawer 15 back to the receiving place 12, where the drawer 15 encounters another limit switch 39 and thus switches off the motor.

For a further protection from unauthorized manipulations, the interaction of the conveying spindle 31 with the limit switches 38 and 49 forms still another locking and alarm mechanism. The lid 29 can be opened only when the drawer 15 is in its extreme position at the removal place 13. Only then does the limit switch 38 release the drive of the conveying spindle 31. The lid 29 cannot be moved against the drive which is at a standstill, since the worm gear of the conveying spindle 31 is self-locking due to a suitable choice of its pitch.

If the lid 29 is then moved by the use of force, then the operating state messages "lid not closed" (limit switch 49) and "drawer not in its extreme position" (limit switch 38) form an alarm signal through a logic operation.

In FIGS. 3 and 4 is represented a further embodiment example of a device for dispensing certificates and coins through the wall 66 of a safe. The drawer 51 for the material conveyed 65 is suspended on cables 52 in such a way that it moves away with the cables 52 when the latter are driven by the shaft 53 by means of the driving rollers 54 rigidly joined to it. The driving means are on the inside of the safe for protection against manipulations. Another pair of rollers 55 on the outside of the safe serves for returning the endless cable 52. Outside the safe are the cables 52 and the pair of rollers 55, preferably under an armored cover (not shown) in order to withdraw them from access from the outside.

The side walls of the drawer are provided with fitting plates 56 for fastening the cables 52 to the drawer 51.

On the side of the drawer 51 turned toward the interior of the safe, the bottom 57 of the drawer 51 is fastened to the underside of the drawer 51 with a hinge frame 58 parallel to the shaft 53. On its side turned toward the outside of the safe, the bottom 57 is kept closed by a releasing mechanism 59.

After being loaded with certificates and coins, the delivered material 65, the drawer 51 at the receiving place 60 is conveyed to the removal place 61, where the release mechanism 59 is forced against a stop 62 and thus the bottom 57 is released. This drops down, pivoting around the hinge frame 58, and assumes approximately the position designated as 57A. The delivered material 65 slides from the bottom which is in the position 57A and is taken over by further conveying means which as an example are represented as the conveyer belt 63.

After it is emptied, the drawer 51 is conveyed back to the receiving place 60. The bottom of the drawer 51, which is still in the position 57A, then slides over guide rollers 64 and is thereby raised upward until it is again parallel to the underside of the drawer and again catches on the release mechanism 59, in which way the drawer 51 is closed up.

Figure 5:
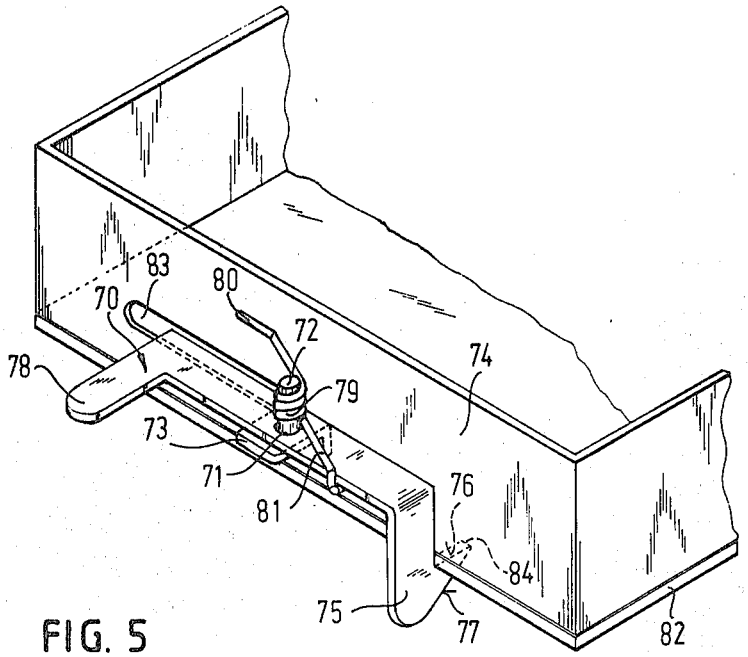
FIG. 5 shows a perspective representation of the lid bottom releasing mechanisms from FIG. 3.

FIG. 5 shows an embodiment example of the release mechanism 59. The bolt 70 is preferably formed from a flat metal strip. It is provided with a bore 71 approximately in its center with which the bolt is pivoted on a metal pin 72. This in turn is joined firmly with the front wall 74 of the drawer by means of a bar 73. The bolt 70 represents a two-armed lever, one arm 75 of which is bent downward at a right angle in such a way that its end overlaps the bottom 82 of the drawer. The part of the bolt projecting out over the drawer bottom is formed in a hook shape so that on the one hand a surface 76 parallel to the drawer bottom 82 is formed and on the other hand a sliding surface 77 running obliquely to the drawer bottom 82 is formed. The second lever arm 78 extends out substantially at a right angle to the front wall 74 of the drawer.

A torsion spring 79 is mounted on the metal pin, the one arm 80 of which spring is supported against the front wall 74 of the drawer and the other arm 81 holds the bolt 70 tensionally in its position holding the drawer bottom 82.

If a force directed in the direction of the front wall 74 of the drawer is now exerted on the second lever arm 78 of the bolt 70, then the bolt pivots around the metal pin 72 in such a way that the drawer bottom 82 is released and drops down. The part of the second lever arm 78 which in the locked state is parallel to the front wall 74 of the drawer dips into a suitably formed cutout 83 in the front wall 74 of the drawer, in the releasing position, so that its free motion is not hindered.

After the force applied to the second lever arm 78 is ended, the bolt returns to its locking position due to the tension of the torsion spring 79. In order to close the drawer bottom 82 again, the latter is again raised against the underside of the drawer. This underside then encounters the sliding surface 77 on the first lever arm 75 of the bolt 70. The bolt is shifted by the force raising the drawer bottom 82, in the direction of the release position, in which way the torsional spring 79 becomes tensioned. If the drawer bottom 82 is raised up over the hook points 84, then the bolt 70, driven by the torsional spring 79, snaps back into the locking position, the drawer bottom 82 rests on the bolt surface 76 and thus remains closed even after the cessation of the force applied to raise the bottom.

Figure 6:
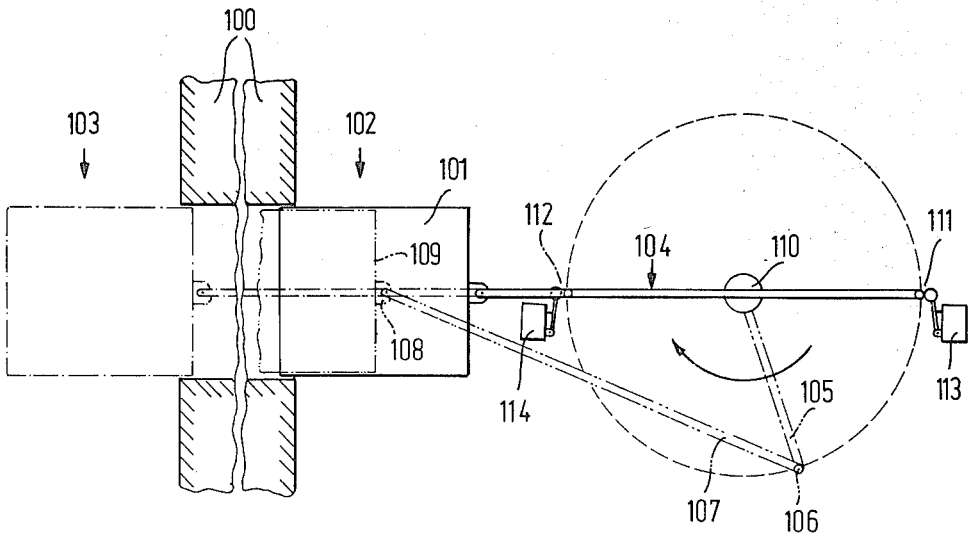
FIG. 6 shows a top plan view of a conveying device with a conveying drawer driven by a crank drive.

FIG. 6 represents a third embodiment example of a device for dispensing certificates and coins through the wall 100 of a safe. The drawer 101 for the material conveyed slides to and fro on guiding means, not represented, between the receiving place 102 and the removal place 103. The drawer is driven by a crank drive 104 which is accommodated in the interior of the safe.

The crank drive 104 essentially consists of a crank 105 which is connected with one end of a driving rod 107 by way of a swivel joint 106. The other end of the driving rod 107 is supported on the rear wall 109 of the drawer 101 by way of a second swivel joint 108. The crank 105 is rigidly connected with the shaft 110 of a driving motor, not represented.

Limit switches 113 and 114, respectively, are arranged at the dead center positions 111 and 112 of the crank drive 104, wherewith the switch 113 signals the extreme position of the drawer 101 at the receiving place 102 and the switch 114 signals its extreme position at the receiving place 103. The driving motor is switched off by these respective signals.

After the conveying drawer 101 is loaded at the receiving place 102 the driving motor is switched on and the crank 105 is rotated by 180° in the direction of the arrow. In this way the drawer 101 is conveyed to the removal place 103. When this position is reached the limit switch 114 is actuated, whereby the driving motor is switched off. After the removal of the material conveyed from the drawer 101 the motor is switched on again, whereupon the crank 105 rotates by another 108° in the direction of the arrow until the limit switch 113 is actuated. The motor is switched off thereby and the drawer 101 is back at the receiving place 102 again.

I claim:

1. A device for conveying objects such as bank notes and coins from a security area to a dispensing point through a safe wall comprising:

drawer means reciprocally movable from the security area to the dispensing point;

motor-powered drive means for moving the drawer upon enablement thereof between the security area and the dispensing point;

normally closed access means associated with the drawer means in the dispensing point and operable between closed and opened conditions;

first control means for automatically enabling the access means only when when the drawer means substantially fully reaches the dispensing point; and second control means for automatically preventing the enabling of said motor powered drive means to return the drawer means to the security area until the drawer means is empty.

2. Apparatus as claimed in claim 1, characterized in that the access means comprises a movable wall and an electric-motor drive disposed in an access opening of a dispensing compartment surrounding the dispensing point, said first control means comprising a limit switch switching on the electric-motor drive.

3. Apparatus as claimed in claim 1, characterized in that the access means comprises a hinged bottom panel of the drawer means which swings downward; the first control means comprising a control element constructed as a releasing mechanism and forming a sliding surface for the contents of the drawer.

4. Device as claimed in claim 2, characterized in that the drawer means is provided with light passage openings, and that at the dispensing point the second control means includes optoelectronic signal device arrangements the signals from which cause the movable wall to be returned to its closed position.

5. Device as claimed in claim 4, characterized in that the movable wall in its movement out of the closed position actuates a locking mechanism which retains the drawer at the dispensing point and is releasable into the closed position by the reverse motion of the wall.

6. Device as claimed in claim 3, characterized in that a roller arrangement parallel to the drawer bottom is provided just below the level of the drawer bottom at the wall opening and that the release mechanism is constructed as a stop mechanism with which the hinged bottom part is locked when it swings up.

7. Device as claimed in claim 6, characterized in that the release mechanism is arranged on the drawer and can be actuated by a stop assigned to the dispensing position.

8. Device as claimed in claim 1, characterized in that the drive means is an electric motor which drives driving elements provided on both sides of the drawer over the length of its range of movement.

9. Device as claimed in claim 8, characterized in that the driving elements provided are preferably self-locking worm-gear spindles on which the drawer is conveyed by means of lateral conveying worm gears.

10. Device as claimed in claim 8, characterized in that the driving elements provided are endless cables on which the drawer is suspended.

11. Device as claimed in claim 1, characterized in that the drive means is an electric motor which is coupled by way of a crank drive with the drawer, the driving rod of which is pivoted on the back side of the drawer.

12. Device as claimed in claim 2, characterized in that the limit switch actuates a reversing drive which couples at least one of the driving elements with a worm drive for the movable wall.

13. Device as claimed in claim 11, characterized in that limit switches are provided as control elements at the dead center positions of the crank drive, which switches respectively switch the electric motor on and off.

* * * * *